United States Patent [19]

Bleher et al.

[11] Patent Number: 4,750,253

[45] Date of Patent: Jun. 14, 1988

[54] METHOD AND APPARATUS FOR PRODUCING A FLAT SPIRAL LINK ASSEMBLY

[75] Inventors: Fritz Bleher, Reutlingen; Klaus Esser, Kuchen; Hans-Eugen Häcker; Rudi Hess-Bauer, both of Reutlingen; Eugen Kehrer, Tübingen; Hartmut Waldvogel, Reutlingen, all of Fed. Rep. of Germany

[73] Assignee: Hermann Wangner GmbH & Co., KG, Reutlingen, Fed. Rep. of Germany

[21] Appl. No.: 944,116

[22] Filed: Dec. 22, 1986

[30] Foreign Application Priority Data

Dec. 23, 1985 [DE] Fed. Rep. of Germany ..... 3545805

[51] Int. Cl.[4] ..... B21F 3/12

[52] U.S. Cl. ..... 29/433; 29/241; 140/5; 264/281; 264/288.4; 264/290.5

[58] Field of Search ..... 29/433, 241; 245/6; 140/5; 264/288.4, 290.5, 281; 198/853; 59/79.2, 83, 20

[56] References Cited

U.S. PATENT DOCUMENTS

| | | | |
|---|---|---|---|
| 3,300,030 | 1/1967 | Scherfel | 245/6 X |
| 4,346,138 | 8/1982 | Lefferts | 428/222 |
| 4,392,902 | 7/1983 | Lefferts | 156/161 |
| 4,423,543 | 1/1984 | Leuvelink | 29/433 |

FOREIGN PATENT DOCUMENTS

| | | | |
|---|---|---|---|
| 0036972 | 3/1981 | European Pat. Off. . | |
| 0054930 | 12/1981 | European Pat. Off. . | |
| 0018200 | 10/1983 | European Pat. Off. . | |
| 2938221 | 10/1980 | Fed. Rep. of Germany | 428/222 |
| 3402620 | 7/1984 | Fed. Rep. of Germany . | |
| 3416234 | 12/1984 | Fed. Rep. of Germany . | |
| WO82/03097 | 9/1982 | PCT Int'l Appl. . | |
| 0019045 | 10/1912 | United Kingdom . | |

*Primary Examiner*—Mark Rosenbaum
*Assistant Examiner*—Frances Chin
*Attorney, Agent, or Firm*—Sughrue, Mion, Zinn, Macpeak and Seas

[57] ABSTRACT

The method produces a flat spiral link assembly from at least four synthetic resin monofilament helices wound winding to winding which are simultaneously supplied for meshing engagement. Before being meshed the helices are stretched to at least three times their length and are thermoset in stretched condition. The alternatingly right-hand and left-hand helices are caused to mesh in zipper fashion and are interlocked by pintle wires. In order to facilitate the insertion of the pintle wires the helices are extended by about five percent. The apparatus for performing the method comprises two feed rolls forming a first roll nip through which helices are passed to a heating chamber. Draw-off rolls withdraw the helices from the heating chamber at least at three times the peripheral speed of the feed rolls. The apparatus also comprises a shunt for joining the helices and a device for inserting the pintle wires.

4 Claims, 8 Drawing Sheets

METHOD AND APPARATUS FOR PRODUCING A FLAT SPIRAL LINK ASSEMBLY

BACKGROUND OF THE INVENTION

The present invention relates to a method and an apparatus for producing a flat spiral link assembly in which left-hand and right-hand heices are alternately meshed and interlocked by pintle wires so that each pintle wire is disposed in the passages formed by the overlap of at least three helices. The helices are produced from synthetic resin monofilament and conventionally have an oval cross section.

According to German Patent DE-A No. 2,938,221, the helices generally do not exhibit any tension or compression spring bias, i.e., when taken out of the assembly they retain the pitch they have in the spiral link assembly. Spiral link assemblies in which each pintle wire is disposed in the interior of at least three helices or, in other words, in which at least three pintle wires are disposed in the interior of each helix are known from EP-A No. 18,200; GB-A No. 19,045; DE-A No. 3,416,234; U.S. Pat. No. 3,300,030; and U.S. Pat. No. 3,308,856, and DE-A No. 3,402,620. A similar spiral link assembly is known from U.S. Pat. No. 3,563,366, but in this patent all the helices are wound in the same sense of direction and the winding arcs of the helices are mutually intertwined, thereby holding between them the pintle wire.

Helices made of synthetic resin monofilament are normally wound in closely packed windings since only in this state can they be stored in cans or containers. They have a pitch corresponding to twice the diameter of the synthetic resin monofilament. If helices are made with a higher pitch, there is the risk that they will become inextricably entangled in the storage container. While conventional spiral link belts, such as disclosed in German De-A No. 2,938,221, in which each helix encloses only two pintle wires, can be made from narrowly wound helices and also from helices having a pitch corresponding to twice the diameter of the synthetic resin monofilament, i.e., a pitch which later on results automatically in the spiral link belt, spiral link belts in which each helix encloses at least three pintle wires cannot be made from narrowly wound helices since the meshing helices would develop such a high contractive force that after assembly they could only be shifted relative to their longitudinal axes with great difficulty and then the insertion of the pintle wires into spiral link belts of greater width would become impossible. For such spiral link belts it therefore has hitherto been possible only to produce the helices on the winding machine with accordingly high pitch and then to directly feed the helices to the assembling device where the helices are then meshed. Intermediate storage was not possible because then the helices would have become entangled in an inextricable mess.

Apparatus for meshing a plurality of helices and for inserting the pintle wires are known from EP-A No. 36,972 and EP-A No. 54,930, and WO No. 82/03097. However, in these embodiments each pintle wire connects only two helices each. These apparatus are not suited to produce spiral link assemblies from helices of high pitch, i.e., of spiral link assemblies with three or more pintle wires passing through each helix.

SUMMARY OF THE INVENTION

The present invention has the object of providing a method of producing spiral link assemblies in which three or more pintle wires pass through each helix without the need of feeding the helices directly from the helix winding machine, and an apparatus for carrying out such a method.

The object of the present invention is realized by simultaneously supplying at least two left-hand and two right-hand helices closely wound winding to winding by stretching the helices prior to assembly at least three times their length and thermosetting the helices in stretched condition.

The present invention offers the advantages of permitting economical and efficient manufacture of such spiral link belts. In the manufacture of spiral link belts with only two pintle wires within each helix, the helices, after having been made to mesh in zipper fashion already exhibit a certain coherence due to the widening of the winding heads and can be handled in this form. Helices having a pitch equal to three times the helix wire diameter, as used in the method of this invention will come apart again immediately unless secured by pintle wires and therefore are difficult to handle. The method of the invention eliminates this problem in that the helices are stretched to the required pitch in a continuous process, meshed, and connected by pintle wires. The method of the invention is suited for the production of spiral link assemblies of an even number of helices, e.g., four, six, or eight helices.

The helices preferably consist of monofilaments of a thermosettable synthetic resin. The synthetic resin is selected according to the end use of the spiral link belt. In general polyester or polyamide monofilament is used for the helices. The helices may alternatingly consist of different materials, e.g., alternatively of polyester monofilament and polyamide-6,6 monofilament. Hellices of multifilament may also be used and in that case the helices may consist alternatingly of monofilimentary wire and multifilimentary wire.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
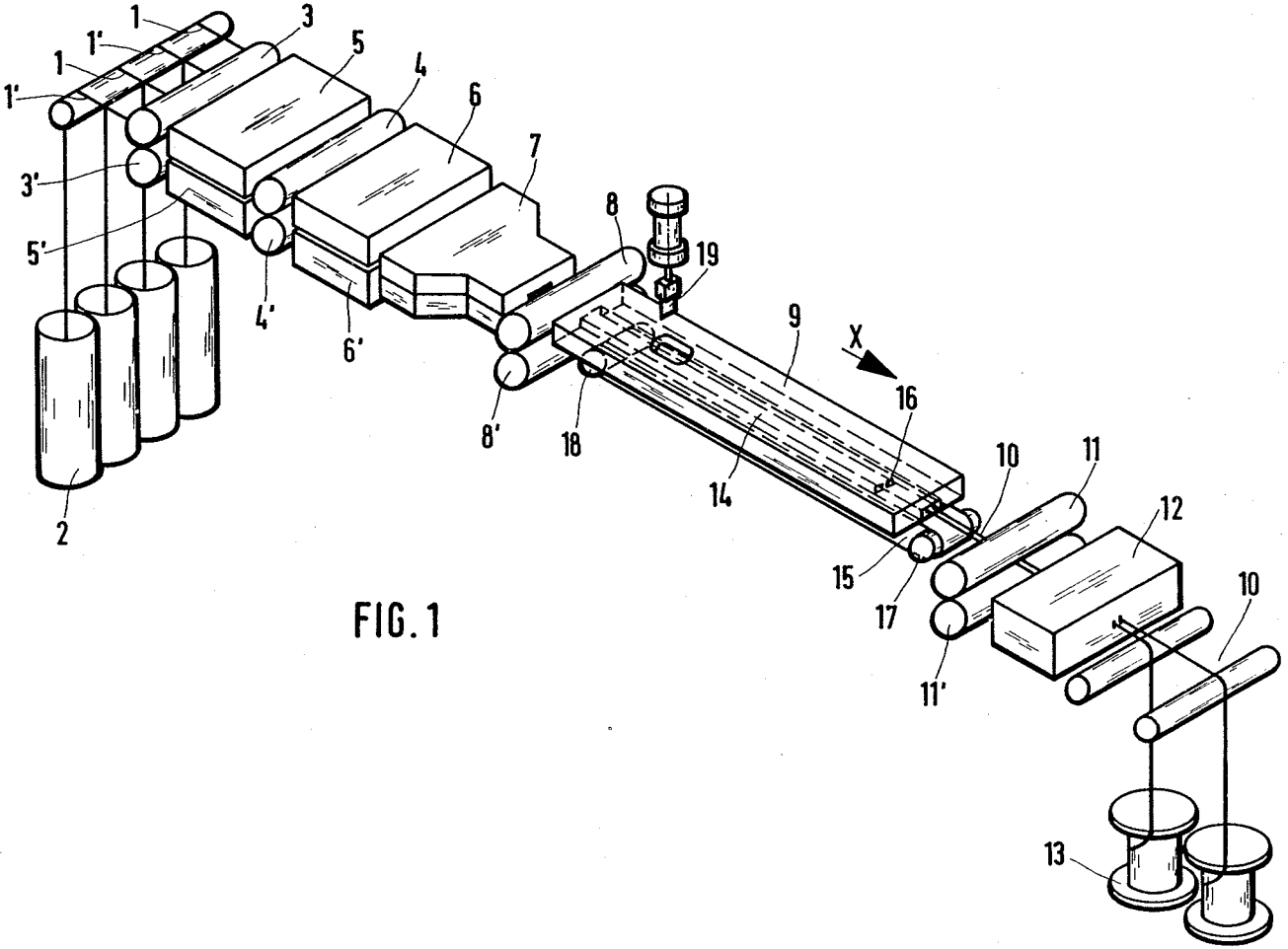
FIG. 1 is a perspective schematic view showing a first form of an apparatus for producing a spiral link assembly according to the present invention.

In the embodiment of FIG. 1, two left-hand helices 1 and two right-hand helices 1' are withdrawn from containers 2 in which they are loosely deposited. The left-hand and right-hand helices 1 and 1' are wound closely, winding to winding, and in this state they are deposited and stored in containers 2. Closely wound helices can be withdrawn without the risk that the helices become entangled. The helices 1 and 1' are withdrawn without the risk that the helices become entangled. The helices 1 and 1' are withdrawn by feed rolls 3, 3', for example, at a rate V of 1 m/min. The feed rolls 3, 3' are followed by a heating chamber 5 in which the helices are heated to a temperature required for thermosetting. The heating chamber 5 is followed by draw-off rolls 4 and 4' whose surface speed is adjustable at a certain ratio to the surface speed of the feed rolls 3, 3'. In the illustrated example the surface speed of the draw-off rolls 4, 4' is three times the surface speed of the feed rolls 3, 3'. Consequently, in the heating chamber 5 the helices are continuously stretched by the factor 3. From the draw-off rolls 4, 4' the still hot helices 1 pass into a cooling means 6 where the helices are cooled to room temperature.

Figure 7:
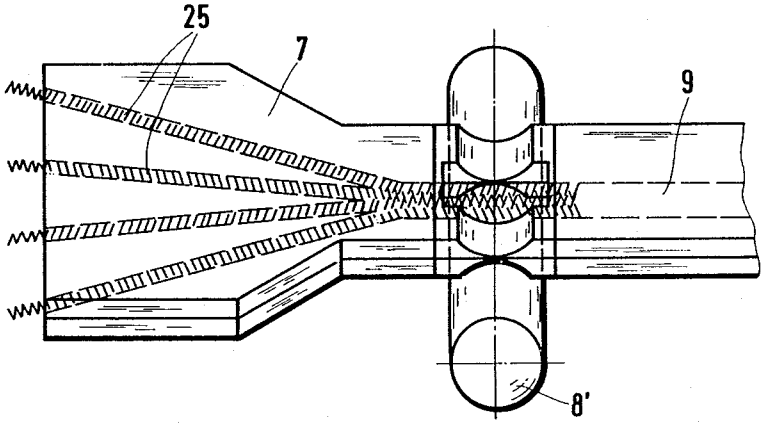
FIG. 7 is a perspective schematic view showing the shunt for meshing the helices in which, for reasons of clarity, the upper draw-off roll is omitted and the passages in the shunt not visible from the outside are shown in broken lines.

From the cooling means 6 the helices 1, 1' travel into a shunt 7 where they are meshed in zipper fashion. The shunt 7 consists of a number of tunnels 25 corresponding to the number of helices 1, 1' of a cross section receiving and guiding the helices 1, 1' with minor clearance. The tunnels converge at acute angles and combine to form a channel of about twice the width (FIG. 7) of an individual helix 1, 1'.

A further pair of draw-off rolls 8, 8' coupled mechanically or electrically to the draw-off rolls 4, 4' draws the meshing helices 1, 1' out of the shunt 7 and conveys them into a channel 9 of a height slightly exceeding the minor cross sectional dimension of the helices 1, 1' and of a width about twice the major cross sectional dimension of the helices 1, 1'. The upper roll 8 is omitted in FIG. 7 for better clarity. The channel 9 has a length substantially exceeding the width of the spiral link belt to be produced from the spiral link assemblies to allow for extension of the helices 1, 1' during the insertion of pintle wires 10, When the meshing helices 1, 1' have arrived at the end of the channel 9 the pintle wires 10 are pushed into the helices 1, 1'. The pintle wires 10 are moved by a pair of rolls 11 in a direction opposite to the direction of travel of the helices 1, 1' and are thereby inserted into the passageways formed in the interior of the helices 1, 1' by the overlap thereof. In the illustrated example in which four helices are meshed to form a spiral link assembly two passages are formed by each three helices 1, 1' of overlapping cross sections. If six or eight helices 1, 1' are combined to form a spiral link assembly they form four or six passages, respectively, in the interior of the helices by the mutual overlap of three helices 1, 1' into each of which pintle wires 10 are inserted. Before their insertion into the helices 1, 1' the pintle wires are withdrawn from coils 13 and straightened in a heating chamber 12.

Figure 8:
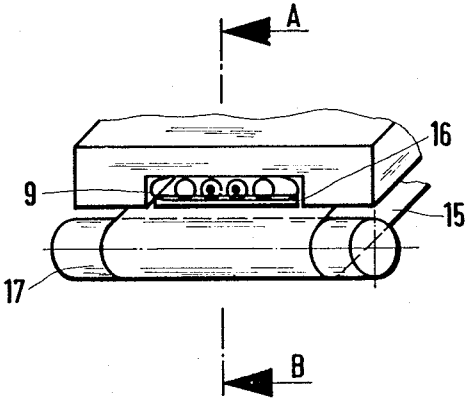
FIG. 8 is a perspective schematic view showing the front end of the passageway receiving the spiral link assembly during the introduction of the pintle wires.
Figure 9:
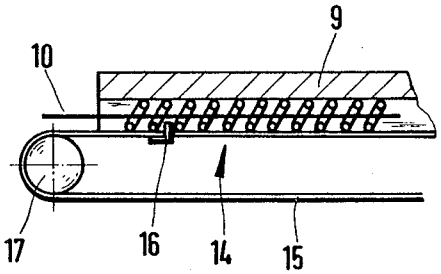
FIG. 9 is a section view taken along the line A–B in FIG. 8.

Below or above the channel 9 an extending means 14 is mounted which permits extension of the helix strands 1 and 1' in the X-direction during insertion of the pintle wires 10 (FIGS. 8 and 9). The extension of the helices 1 and 1' in the X-direction amounts to about five percent and is so selected that the pintle wires 10 can be pushed into the helices 1, 1' with a minimum of resistance. The extending means 14 comprises a rotating perforated belt 15, a chain, or a toothed belt, on which a catch 16 is provided. The catch 16 engages the helices and for this purpose its leading end is so designed that it can enter into the pitch of the helices 1, 1'. As will be seen from FIG. 8 the catch 16 is designed in the manner of a relatively low rib extending perpendicularly from the belt 15. In FIG. 1 the catch 16 is designed in the manner of a rake. The perforated belt 15 passes over rolls 17 and 18 driving it at a speed of three times V plus about five percent. The belt 15 is driven by the toothed roll 17 electrically coupled via a timer/regulator unit to the draw-off rolls 8 and 8'. When the helices 1, 1' reach a position above the center of the roll 18, the roll 17 is actuated and drives the belt 15, and the catch 16 engages the leading end of the helices 1, 1' and draw them through the channel 9. Automatic actuation can be effected, for example, by a light barrier, now shown, positioned above the channel 9. By way of a further light barrier the drive of roll 17 is inactivated when the helices 1, 1' have reached their foremost position.

Simultaneously with the elongation of the helices 1, 1' the insertion of the pintle wires 10 commences. As soon as the helices 1, 1' have reached their full length, i.e., when they have reached the forward end of the channel 9, the insertion of the pintle wires 10 by way of rolls 11 is also terminated. The now completed spiral link assembly is cut off at the rear end of the channel 9 by a pneumatically actuated cutter 19. The pintle wires 10 are simultaneously cut off by a means, not shown, between the forward end of the channel 9 and the roll 11, and the belt 15 with the catch 16 is returned to its initial position by the timer/regulator unit. The final spiral link assembly can now be removed from the channel 9 and the working cycle is repeated. A plurality of spiral link assemblies produced in this way can now be likewise combined in zipper fashion by means of their marginal helices and the required number of pintle wires 10 are inserted along the individual junction lines.

Along each junction two pintle wires are inserted and, here too, they are inserted into passages formed by the overlap of three helices in cross section. The individual spiral link assemblies are thereby assembled to form a spiral link belt in the same way as previously done in the assembly of spiral link belts from individual helices.

Figure 2:
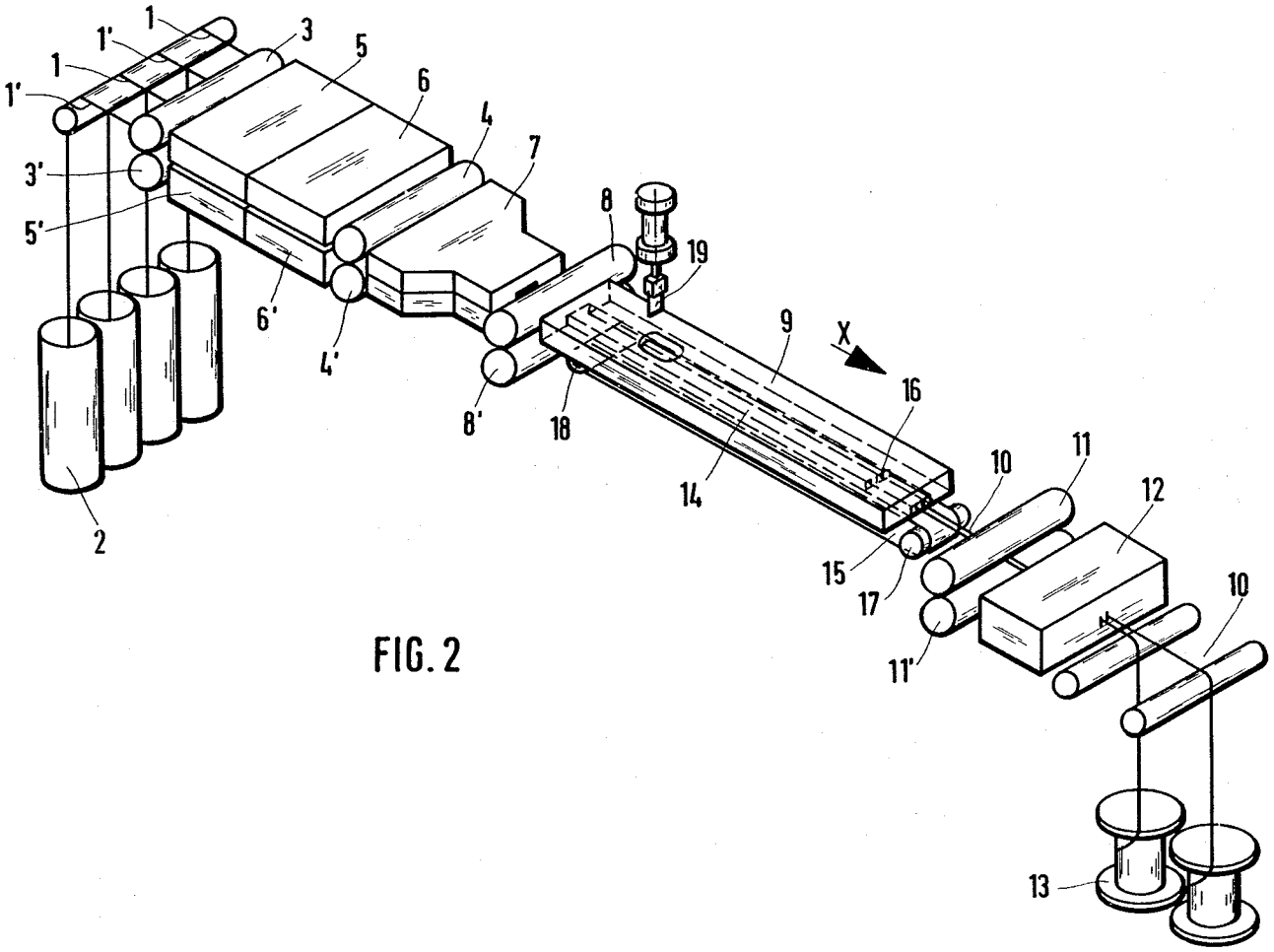
FIG. 2 is a perspective schematic view showing a second form of an apparatus for producing a spiral link assembly according to the present invention.

FIG. 2 shows an example similar to that of FIG. 1 except that the draw-off rolls 4, 4' are disposed between heating chamber 5 and cooling means 6. Therefore, both thermosetting and stretching of the helices 1, 1' takes place between the feed rolls 3, 3' and the draw-off rolls 4, 4'.

Figure 3:
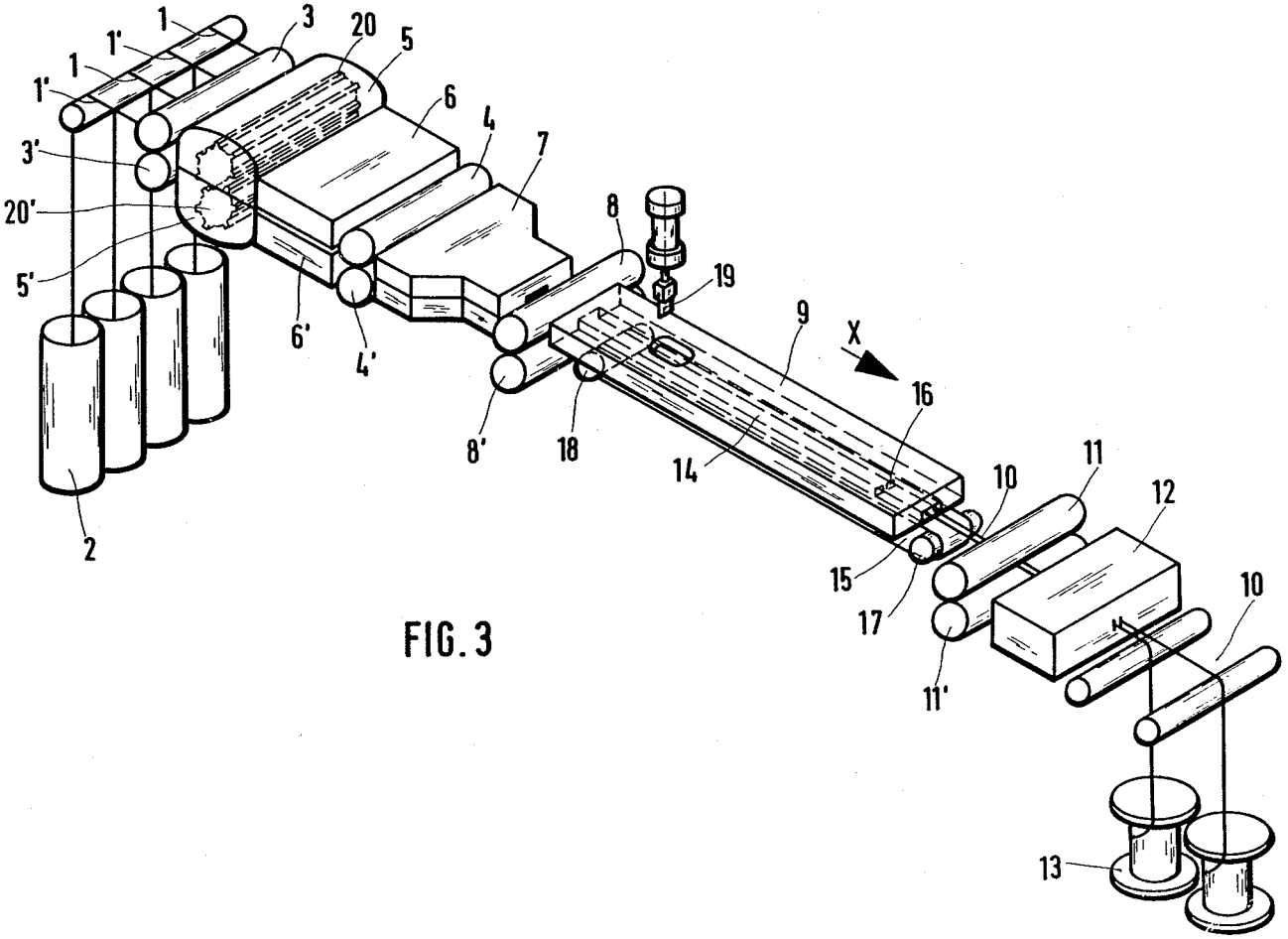
FIG. 3 is a perspective schematic view showing a third form of an apparatus for producing a spiral link assembly according to the present invention.

In the example of FIG. 3 heating chamber 5 and cooling means 6 are also arranged in direct succession, and within the heating chamber 5 embossing rolls 20, 20' are provided which have a surface making positive engagement with the right-hand and left-hand helices 1, 1'. The embossing rolls 20, 20' are coupled mechanically or electrically to the feed rolls 3, 3' and the draw-off rolls 4, 4' and 8, 8'. The embossing rolls 20, 20' rotate at equal surface speeds, which is about three times the surface speed of the feed rolls 3, 3'.

Figure 4:
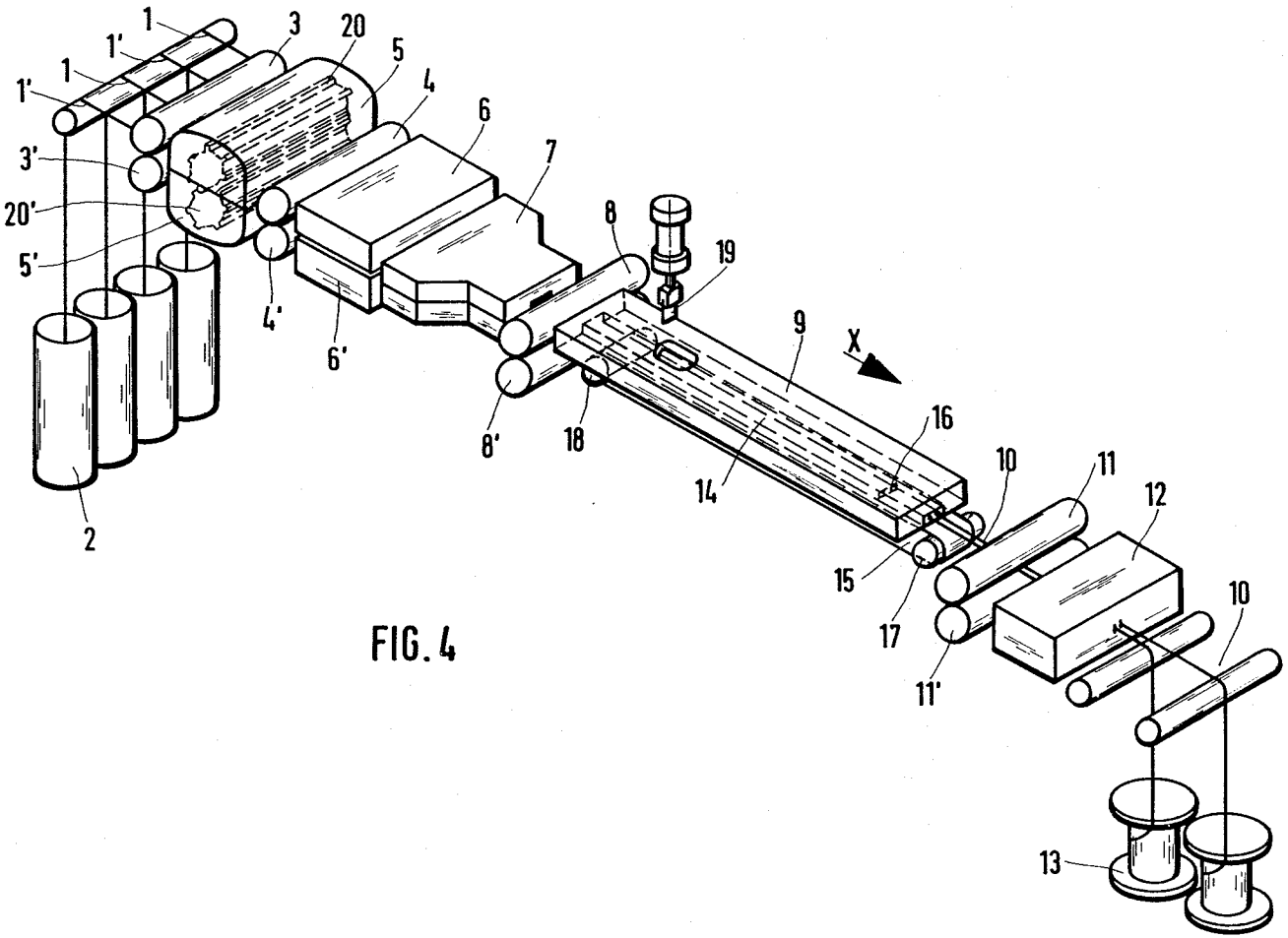
FIG. 4 is a perspective schematic view showing a fourth form of an apparatus for producing a spiral link assembly according to the present invention.

The example illustrated by FIG. 4 is suited especially for helices made from monofilaments of larger diameter because the latter requires longer exposure to heat up the helices 1, 1' to be stretched. The cooling means 6 in this example is disposed downstream of the draw-off rolls 4, 4' so that the helices are cooled after having passed through the nip of draw-off rolls 4, 4'. The embossing rolls 20, 20' are again arranged within the heating chamber 5.

Figure 5:
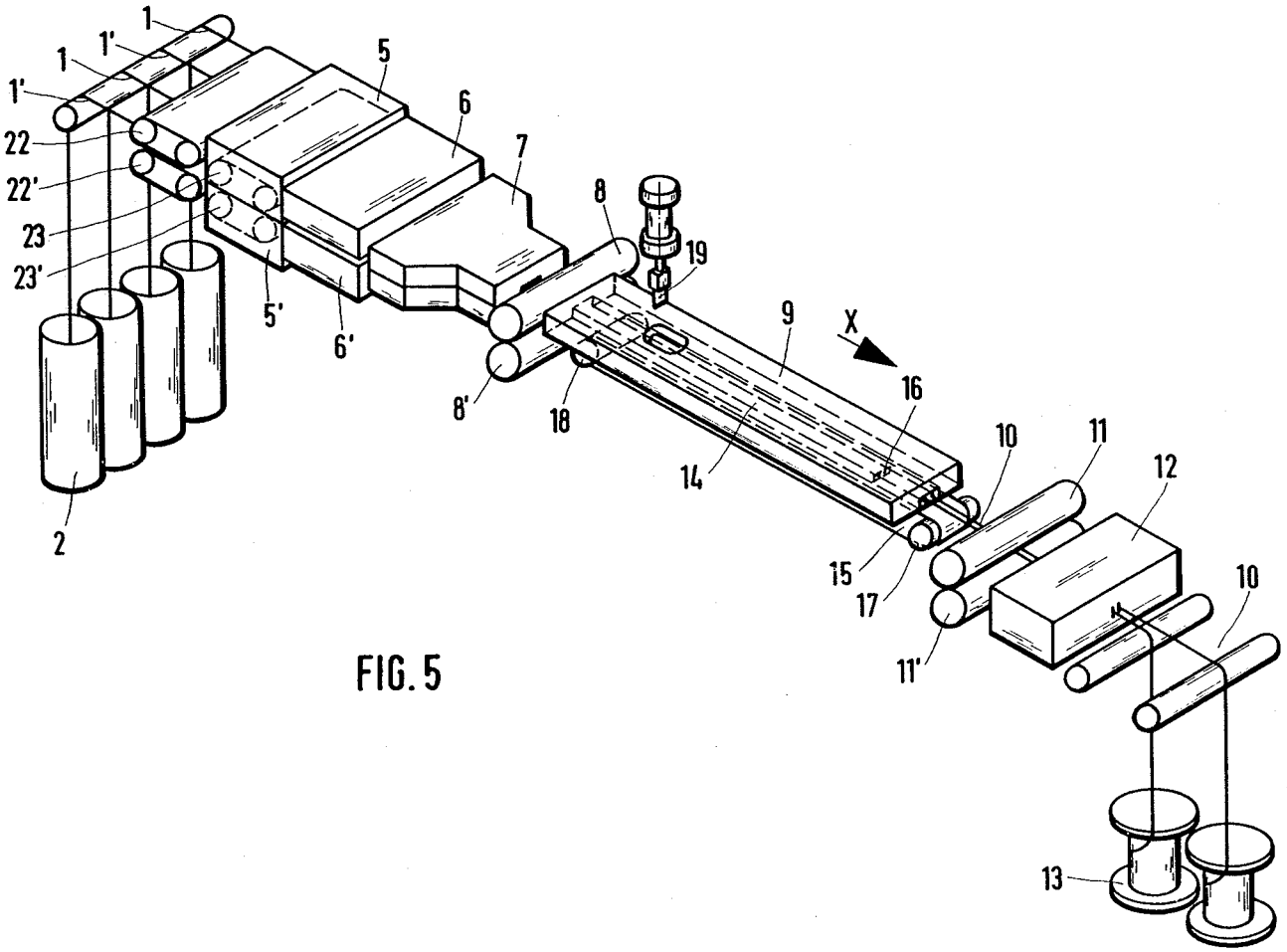
FIG. 5 is a perspective schematic view showing a fifth form of an apparatus for producing a spiral link assembly according to the present invention.

In the example shown in FIG. 5 the feed rolls are replaced by revolving belts 22, 22' with chain-like toothing withdrawing the helices from the containers 2 and forwarding them to revolving belts 23, 23' within the heating chamber 5. The belts 22, 22' and 23, 23' are made of heat resistant material. The belts 23, 23' at the same time replace the draw-off rolls 4, 4' so that the cooling means 6 is arranged directly behind the heating chamber 5. The cooling means 6 is followed by the shunt 7 from which the helices 1, 1' are withdrawn by the draw-off rolls 8, 8'. The means for driving the belts 22, 22' and 23, 23' are mechanically or electrically coupled so that predetermined fixed speed ratios can be adjusted. The surface speeds of the draw-off rolls 8, 8' and of the belts 23, 23' are equal and are three times the surface speed of the belts 22, 22'.

Figure 6:
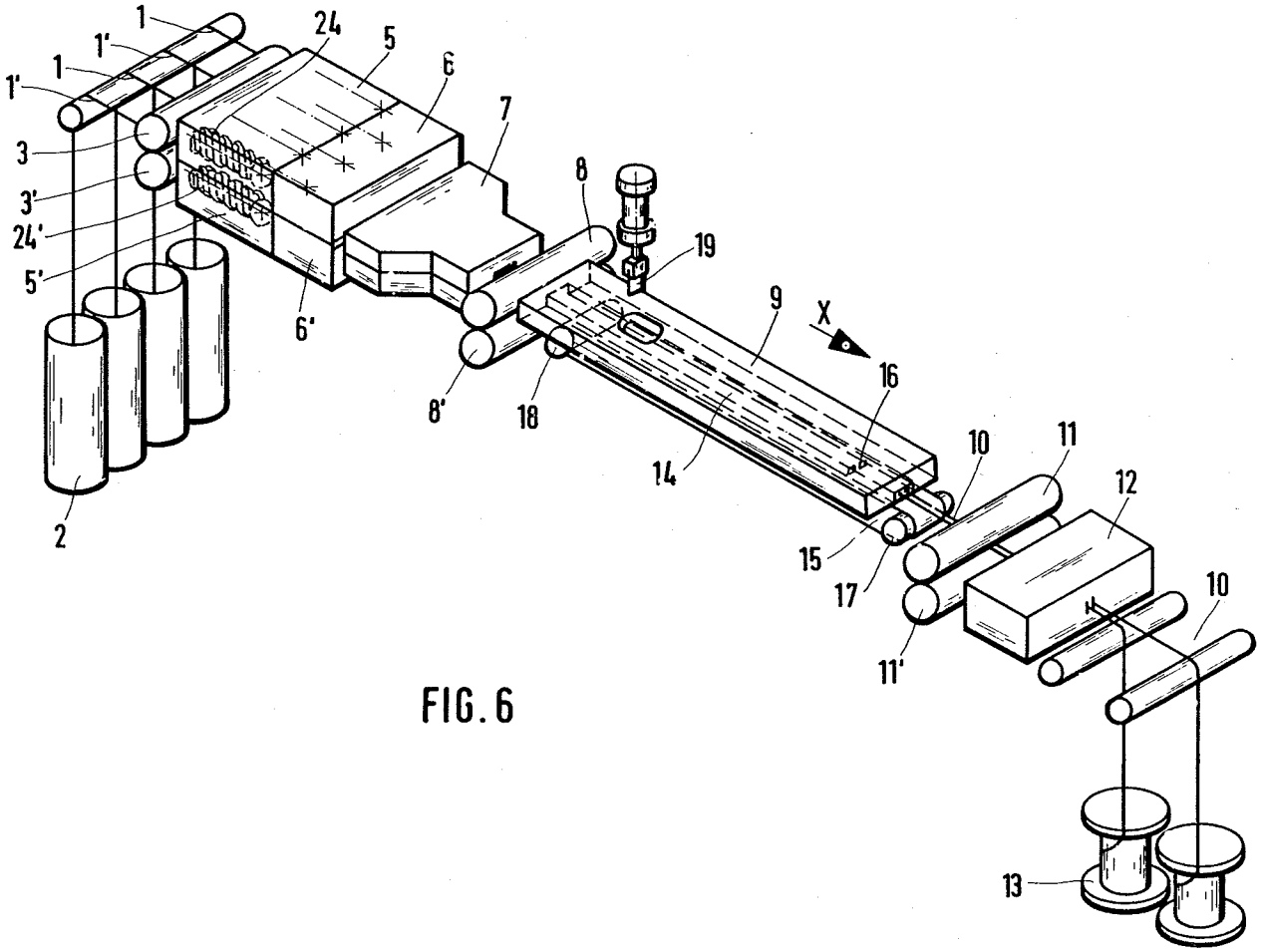
FIG. 6 is a perspective schematic view showing a sixth form of an apparatus for producing a spiral link assembly according to the present invention.

The example of FIG. 6 is substantially identical with that of FIG. 2. However, in the heating chamber 5 conveyor screws or spindles 24, 24' are provided which stretch the helices 1, 1' to the desired length while the latter are being heated and thus increase the pitch of the helices 1, 1' in the desired manner. The conveyor spindles 24, 24' are arranged horizontally in the heating chamber 5 and their pitch is so selected that it corresponds to the desired pitch of the helices 1, 1'. For each helix 1, 1' an upper conveyor spindle 24 and a lower conveyor spindle 24' are provided which grasp the helices 1, 1' between them. The helices are withdrawn from the heating chamber 5 through the cooling means 6 and through the shunt 7 by the draw-off rolls 8, 8'. For smooth operation of the apparatus it is important that a predetermined pitch is precisely imparted to the helices 1, 1'. Preferably the helices 1, 1' are also advanced through the cooling means 6 by way of conveyor screws or spindles. Suitably, the conveyor screws or spindles 24, 24' extend from the entrance into the heating chamber 5 to the exit from the cooling means 6, so that the helices 1, 1' are advanced by one conveyor spindle 24, 24' through the heating chamber 5 and the cooling means 6.

Figure 10:
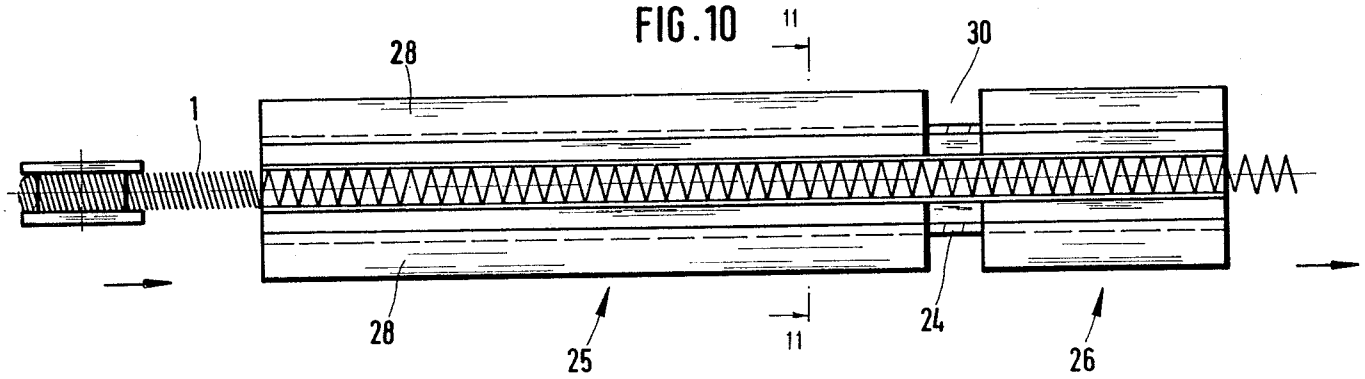
FIG. 10 is a plan view of a conveyor spindle.

FIG. 10 is a plan view of a conveyor spindle 24. The conveyor screw or spindle 24 has a diameter of 46 mm and 15 turns, for example. It is installed in a heat treating chamber comprising a heating zone 25 and a cooling zone 26. The direction of advance in FIG. 10 is from left to right and is indicated by arrows. From FIG. 10 it is discernible that the oncoming helix 1 is wound in closely packed right-hand windings. The conveyor spindle 24 has left-hand threads. From the section shown in FIG. 11 it can be seen that the helix 1 is advanced along a path confined on the underside by the screw turns of the conveyor spindle 24 and on the upper side by a top guide 27 in the form of a simple guide rail. The top guide 27 is omitted in FIG. 10 for clarity reasons. The top guide 27 extends along the entire length of the conveyor spindle 24. On the sides the helix 1 is guided by nozzles 28. The nozzles 28 serve for lateral guidance of the helix 1 and, furthermore, serve to heat and cool the helix 1 by blowing hot air or cold air, respectively, through nozzle passages 29 about the first half to three fourths of the conveyor spindle 24 to form the heating zone 25 within which hot air or hot gas flows through the nozzle passages 29 to the helix 1, thereby heating the same to the heat setting temperature. After a short transitional region 30 the cooling zone 26 follows the heating zone 25 occupying up to one fourth of the length of the conveyor spindle 24. In the cooling zone 26 air of room temperature or cool air is directed through the nozzle passages 29 onto the helix 1.

Figure 12:
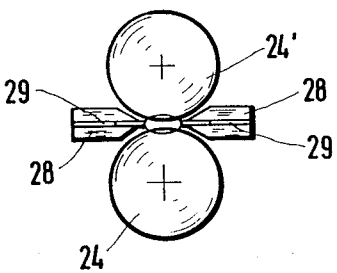
FIG. 12 is a section through a twin conveyor spindle.
Figure 11:
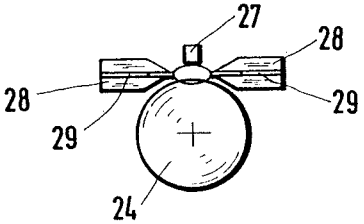
FIG. 11 is a section along line 11—11 in FIG. 10.

The use of such a conveyor screw 24 obviates the feed rolls 3 and the draw-off rolls 4. While FIGS. 10 and 11 show a conveyor means which forwards each helix 1, 1' by an individual conveyor screw or spindle 24, in the conveyor means shown in FIG. 12, lower and upper conveyor screw or spindles 24, 24' are associated with each helix 1, 1'. A right-hand helix is carried along by two left-hand conveyor spindles 24, 24' and, vice versa, a left-hand helix is carried along by two right-hand conveyor spindles 24, 24'. Right-hand conveyor spindles, in this system, perform a left-hand rotation, and left-hand conveyor spindles perform a right-hand rotation, and the two conveyor spindles of a conveyor means rotate in the same direction. After disengaging from the conveyor spindle 24, 24' the helices 1, 1' are meshed in the shunt 7, as described in the preceding examples.

While the invention has been particularly shown and described with reference to preferred embodiments thereof it will be understood by those in the art that the foregoing and other changes in form and details may be made therein without departing from the spirit and scope of the invention.

What is claimed is:

1. A method for producing a flat spiral link assembly in which alternatively right-hand or left-hand synthetic resin helices are meshed in zipper fashion so that their longitudinal axes are disposed in parallel in one plane, the method comprising:

supplying at least two left-hand and two right-hand helices closely wound winding to winding simultaneously;

stretching the helices to at least three times their length;

thermosetting the helices in stretched condition; and meshing said helices in zipper fashion; and connecting the helices by pintle wires inserted through passages each formed by the overlap of at least three helices.

2. The method according to claim 1 further comprising resiliently extending the helices by about five percent subsequent to meshing, and inserting pintle wires into the helices while the latter are in extended condition.

3. The method according to claim 1 further comprising permanently deforming the cross section of the helices during thermosetting to increase the pitch thereof.

4. A method for producing a spiral link belt in which alternatively right-hand and left-hand synthetic resin helices are meshed in zipper fashion so that their longitudinal axes are disposed in parallel in one plane, the method comprising:

producing a number of flat spiral link assemblies by supplying at least two left-hand and two right-hand helices closely wound winding to winding simultaneously;

stretching the helices to at least three times their length;

thermosetting the helices in stretched condition;

meshing said helices in zipper fashion; and connecting the helices by pintle wires inserted through passages each formed by the overlap of at least three helices; and combining the spiral link assemblies by means of their marginal helices and by inserting pintle wires along the junction lines of two spiral link assemblies.

* * * * *